US008553925B2

(12) United States Patent
Milot et al.

(10) Patent No.: US 8,553,925 B2
(45) **Date of Patent: *Oct. 8, 2013**

(54) LOUDSPEAKER

(75) Inventors: Gilles Milot, Paris (FR); Francois Malbos, Yvre l'Eveque (FR)

(73) Assignee: Harman Becker Automotive Systems GmbH, Karlsbad (DE)

( * ) Notice: Subject to any disclaimer, the term of this patent is extended or adjusted under 35 U.S.C. 154(b) by 31 days.

This patent is subject to a terminal disclaimer.

(21) Appl. No.: 13/230,379

(22) Filed: Sep. 12, 2011

(65) Prior Publication Data

US 2012/0002836 A1 Jan. 5, 2012

Related U.S. Application Data

(63) Continuation of application No. 11/544,451, filed on Oct. 6, 2006, now Pat. No. 8,019,112.

(30) Foreign Application Priority Data

Oct. 7, 2005 (EP) ..... 05292093

(51) Int. Cl.
*H04R 25/00* (2006.01)

(52) U.S. Cl.
USPC ..... 381/396; 381/398; 381/412

(58) Field of Classification Search
USPC ..... 381/396, 398, 400, 403–404, 407, 381/412, 423–424
See application file for complete search history.

(56) References Cited

U.S. PATENT DOCUMENTS

| | | | |
|---|---|---|---|
| 4,239,943 | A | 12/1980 | Czerwinski |
| 5,511,131 | A | 4/1996 | Kohara et al. |
| 6,173,065 | B1 | 1/2001 | Lin |
| 8,019,112 | B2 | 9/2011 | Milot et al. |

FOREIGN PATENT DOCUMENTS

| | | | |
|---|---|---|---|
| AT | 294942 | B | 12/1971 |
| DE | 864270 | C | 1/1953 |
| DE | 3447604 | A1 | 7/1986 |
| FR | 2081222 | A | 12/1971 |
| JP | 60185493 | | 9/1985 |

OTHER PUBLICATIONS

EPO Search Report dated Apr. 7, 2006; 5 pages.

*Primary Examiner* — Suhan Ni
(74) *Attorney, Agent, or Firm* — O'Shea Getz P.C.

(57) ABSTRACT

A loudspeaker includes a movable diaphragm, a resilient centering device for centering and guiding the movement of the diaphragm, and a magnet system for controlling the movement of the diaphragm, where the diaphragm is positioned between the magnet system and the resilient centering device.

5 Claims, 2 Drawing Sheets

LOUDSPEAKER

RELATED APPLICATIONS

This application is a continuation of and claims priority to U.S. patent application Ser. No. 11/544,451, filed Oct. 6, 2006, titled LOUDSPEAKER, that claims priority of European Application Serial Number 05 292 093.1, filed on Oct. 7, 2005, titled LOUDSPEAKER; both applications of which are incorporated by reference in this application in their entirety.

BACKGROUND OF THE INVENTION

1. Field of the Invention

This invention relates to a loudspeaker comprising a movable diaphragm oscillating around a position of rest, a resilient centering device for centering and guiding the movement of the diaphragm, and a magnet system for controlling the movement of the diaphragm. The invention relates specially to woofers which are designed to produce low frequencies.

2. Related Art

In a conventional cone loudspeaker, the guiding of the movable diaphragm is realized by a double mechanical guiding system. This type of guiding system consists of a flexible deformable surround portion that secures the diaphragm to a frame of the loudspeaker, and a spider that guides the oscillation movement of a voice coil positioned in the magnet system and of the diaphragm mounted to the coil. The excursion of the moving system is generally limited by the maximum mechanical deformation of the spider.

Loudspeakers may be divided into several categories. First, there exist loudspeakers designed to produce low frequencies, which are called woofers. In these loudspeakers, the diaphragm is large and has a significant excursion. Additionally, loudspeakers are known that are designed to produce higher frequencies, which are called tweeters. These tweeters comprise diaphragms which oscillate at a smaller range of excursions. Lastly, there also exist loudspeakers designed for producing medium frequencies, which are called mediums or midrange loudspeakers.

In woofers and mediums, a double mechanical guiding system consisting of a surround portion and a resilient centering device (e.g. a spider) is normally used. This double mechanical guiding system is necessary to properly guide the oscillating voice coil and the diaphragm over significant excursions.

In vehicles, audio systems are often provided that include different loudspeakers for different frequency ranges. These loudspeakers often need to be installed in different locations of the vehicle compartment. The loudspeakers may be positioned in a box that needs to be incorporated somewhere in the vehicle. Especially the arrangement of woofer loudspeakers is a challenging task, as the woofer has a large volume. This large volume is necessary to produce the large excursions of the diaphragm that are necessary for producing low frequencies. In the vehicle environment there is always a need to minimize the space needed for the components installed in the vehicle, as the available space inside a vehicle is limited. Accordingly, a need exists to provide a loudspeaker that occupies a minimum volume, but at the same time is able to produce significant excursions of the diaphragm. This need is particularly desirable in the case of woofers.

SUMMARY

According to one implementation, a loudspeaker includes a movable diaphragm oscillating around a position of rest.

Additionally, a resilient centering device is provided for centering and guiding the movement of the diaphragm. The loudspeaker further includes a magnet system for controlling the movement of the diaphragm.

According to another implementation, a voice coil is positioned in the magnet system, the voice coil being connected to the movable diaphragm.

According to another implementation, a loudspeaker includes a frame disposed around a central axis, a magnet system mounted to the frame, a resilient centering device, and a diaphragm movable relative to the central axis. The diaphragm is mounted to the frame and mechanically communicates with the resilient centering device. The diaphragm is axially interposed between the magnet system and the resilient centering device.

According to another implementation, a loudspeaker includes a diaphragm movable relative to a central axis, a resilient centering device mechanically communicating with the diaphragm, a magnet system, and a suspension contacting the diaphragm and axially interposed between the magnet system and the resilient centering device.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
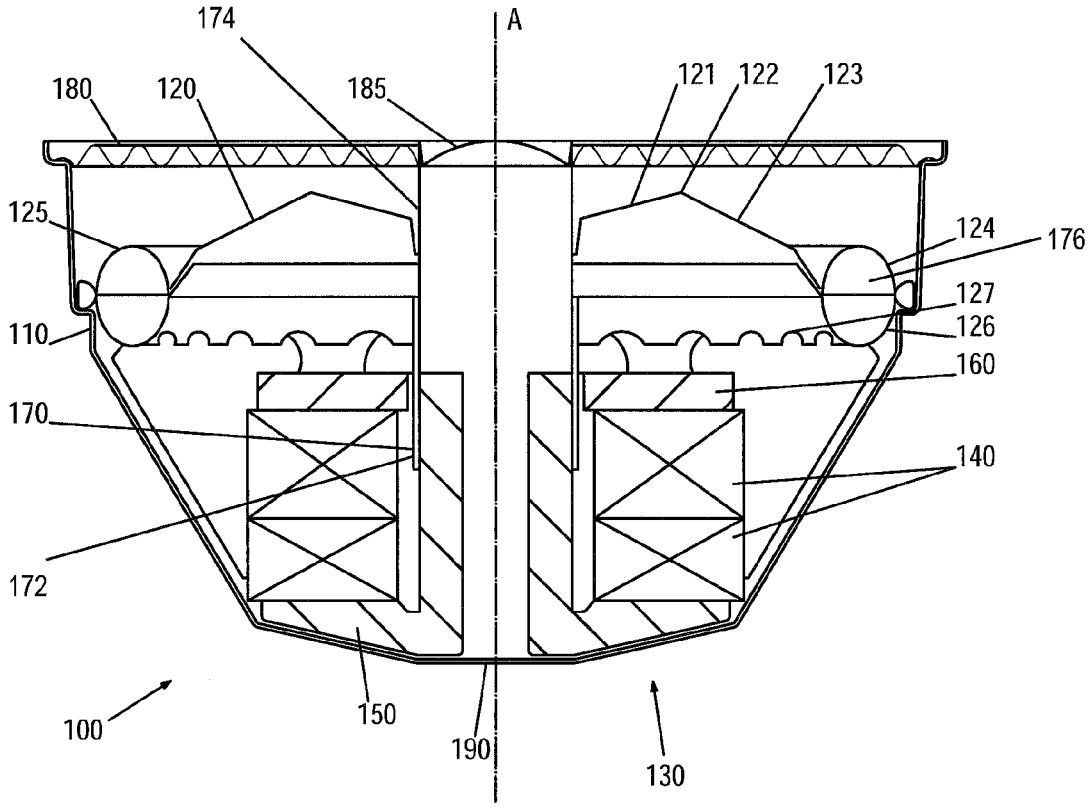
FIG. 1 is a cross-sectional elevation view illustrating an example of a loudspeaker according to one implementation of the invention.

FIG. 1 is a cross-sectional elevation view illustrating an example of a loudspeaker 100 according to one implementation. The loudspeaker 100 may include a frame 110 that may be incorporated into a panel or other suitable structure of a vehicle (not shown). The loudspeaker 100 includes a diaphragm 120 that moves around a position of rest. The diaphragm 120 may be a reinforced paper cone, an aluminum cone, or have any other suitable composition as known from the prior art diaphragms. The movement of the diaphragm 120 is controlled by a motor system 130, the motor system comprising magnets 140 and pole pieces 150 and 160. The magnets 140 and the pole pieces 150 and 160 are arranged in such a way that a gap is provided between the pole pieces 150 and 160 in which a uniform magnetic field is present, in which a voice coil 170 is arranged. In some implementations, as illustrated in FIG. 1, the voice coil 170 may constitute a voice coil assembly that includes an electrically conductive coil 172 wound around a coil support structure 174 such as a coil former, which typically is cylindrical and arranged about the central axis of the loudspeaker 100. As appreciated by persons skilled in the art, the coil 172 may be securely attached to the coil support structure 174 by any suitable means such as adhesive, such that the coil support structure 174 moves with the coil 172 and such movement is translated to the diaphragm 120.

The loudspeaker 100 further includes means for centering and guiding the movement of the diaphragm 120 (and voice coil 170). In the illustrated example, the voice coil 170 is connected to the diaphragm 120 and mechanically communicates with a resilient centering device or spider 180. In the illustrated example, the voice coil 170 mechanically communicates with the resilient centering device 180 by means of the coil support structure 174, which is interconnects the resilient centering device 180 and the diaphragm 120. As illustrated in FIG. 1, the resilient centering device 180 may have a corrugated profile. The resilient centering device 180 is attached to the frame 110 at its front or anterior part. In prior art loudspeakers the position of the resilient centering device and the position of the diaphragm are exchanged compared to the implementation illustrated in FIG. 1. In the middle of the resilient centering device or spider 180 a dust cap 185 is provided which prevents dust from penetrating the loudspeaker 100.

As can be seen in FIG. 1, the provision of the spider 180 on the front side of the loudspeaker 100 allows the use of a spider 180 having a much larger surface than would be the case if the spider 180 were arranged at the location of the diaphragm 120. The spider 180 guides the movement of the voice coil 170 and of the diaphragm 120. According to this implementation, the distortions of the loudspeaker 100 may be minimized by using the large spider 180. The large spider 180 allows more significant excursions as the maximum mechanical deformation of the spider 180 is larger, as the surface of the spider 180 is larger than in loudspeakers of the prior art. The spider 180 should be air permeable to allow the air flowing through it without compression.

As illustrated in FIG. 1, the loudspeaker 100 is designed in such a way that the diaphragm 120 is positioned between the magnet system 130 and the resilient centering device 180. This means that seen from the front side of the loudspeaker 100, the resilient centering device 180 is positioned on the anterior side of the diaphragm 120, or the diaphragm 120 is positioned on the posterior side of the resilient centering device 180. In prior art loudspeakers, the resilient centering device or spider is positioned between the magnet system and the diaphragm, the diaphragm being the most anterior part of the loudspeaker. With this arrangement of the prior art, however, the use of a large spider was only possible when the whole loudspeaker had large dimensions. By contrast, according to the implementation illustrated in FIG. 1, the inversion or reversal of the positions of the diaphragm 120 and the resilient centering device 180 provides the possibility to use a much larger resilient centering device 180 than was possible in the prior art loudspeakers.

As mentioned above, the dimension of the resilient centering device 180 limits the maximum excursion. The provision of the resilient centering device 180 at the outermost part of the loudspeaker 100 provides the possibility to use a much larger resilient centering device 180. This, however, means that with a larger resilient centering device 180, larger excursions of the diaphragm 120 can be obtained. Accordingly, it is either possible to reduce the dimensions of the loudspeaker 100 while maintaining the maximum excursion constant, or it is possible to increase the maximum excursion at a constant size of the loudspeaker 100. When the maximum excursion can be increased, the volume of the displaced air can be kept constant while reducing the size of the loudspeaker 100. Accordingly, it is possible to provide a loudspeaker 100 emitting frequencies in the low frequency range, the size of which is reduced to a large extent. Thus, it is possible to obtain a flat and compact woofer for car cabin applications (e.g. below the seat or in the door) with a small emitting surface, a large excursion and small distortions. The distortion is mainly influenced by the resilient centering device 180 and by the suspension (e.g., surround) with which the diaphragm 120 is mounted to the frame 110 of the loudspeaker 100. By increasing the size of the resilient centering device 180, the distortions may be minimized Due to the novel position of the resilient centering device 180, the surface of the resilient centering device 180 may in some implementations be increased by approximately 70 percent without increasing the sound emitting surface.

In some implementations, the diameter (e.g., outer diameter) of the resilient centering device 180 is larger than the diameter (e.g., outer diameter) of the diaphragm 120. This large surface of the spider 180 helps to obtain large excursions of the diaphragm 120, the large dimension of the spider 180 being possible due to its position on the anterior side of the diaphragm 120. By way of example, when the outer diameter of the loudspeaker 100 is 120 mm, a maximum mechanical excursion of the diaphragm 120 may be around 15-17 mm to the posterior side and to the anterior side, resulting in a total excursion of up to 34 mm. This significant excursion is not possible with a prior art loudspeaker having a diameter of around 120 mm. The excursion of the implementation shown in FIG. 1 may not only depend on the outer diameter of the loudspeaker 100, but also on its optimized thickness, which may be around 71 mm.

The loudspeaker 100 may further include means for securing the diaphragm 120 to the loudspeaker 100, e.g., to the frame 110. In the illustrated example, the diaphragm 120 may be attached to the frame 110 by a flexible deformable suspension or surround portion 125. In some implementations, the diameter (e.g., outer diameter) of the resilient centering device 180 is larger than the diameter (e.g., outer diameter) of the suspension 125.

In one example, the suspension 125 supporting the diaphragm 120 may be provided in the form of a double-surround, vented configuration such as described in European Patent Application EP 1 484 941 A1, which is commonly assigned to the assignee of the present disclosure, and the entire content of which is incorporated by reference in the present disclosure. The provision of this type of suspension 125 may result in a better guiding of the movement of the diaphragm 120 and/or the voice coil 170 to which the diaphragm 120 is connected, and/or may result in better minimization of distortions. According to this example, as illustrated in FIG. 1, the surround portion 125 may include a first, convex-shaped flexible surround portion 124 and a second, concave-shaped flexible surround portion 126 that cooperatively define a closed space 176 between the two portions 124 and 126. From the perspective of FIG. 1, the first convex-shaped flexible surround portion 124 is "convex" in the sense that its anterior side faces the centering device 180 and bulges upward generally in the direction of the centering device 180, and its posterior side defines an interior space that generally faces downward toward the magnets 140. The second concave-shaped flexible surround portion 126 is "concave" in the sense that its anterior side defines an interior space that generally faces upward and its posterior side bulges generally in the downward direction. In the example specifically shown in FIG. 1, the portion 126 comprises holes 127, the holes 127 permitting airflow between the space inside the two flexible surround portions 124 and 126 and the outside. It should be understood that the air holes 127 could alternatively be provided in the other portion 124 to allow the emission of air. However, it has to be made sure that either portion 124 or portion 126, and not both portions 124 and 126 are air-permeable, as otherwise the loudspeaker 100 may not function properly. That is, either the first or the second flexible surround portion 124 or 126 may be air-permeable. Additional advantages and/or features of the illustrated double surround configuration are described in more detail in European Patent Application EP 1 484 941 A1, referenced above.

The loudspeaker 100 illustrated in FIG. 1 is designed in such a way that the excursions of the diaphragm 120 for the given loudspeaker size are as significant as possible. The diaphragm 120 and especially the form of the diaphragm 120 may be designed in such a way that a large excursion of the diaphragm 120 may be obtained allowing the maximum mechanical excursion towards the motor system 130 and the spider 180. Moreover, in certain low-frequency implementations such as flat subwoofer applications, the diaphragm 120 may be designed in such a way that the thickness of the loudspeaker 100 is decreased. In some implementations, the diaphragm 120 is convex-shaped and is annular by shape. Starting from the symmetrical axis A and moving generally radially (or orthogonally) outward, the diaphragm 120 may include an ascending part 121 connected to the voice coil 170, an apex 122, and a descending part 123 in connection with the deformable surround portion 125. This shape of the diaphragm 120 is optimized to prevent the diaphragm 120 from contacting the resilient centering device 180 on the one side and the magnet system 140 on the other side of the diaphragm 120 at significant excursions.

The motor system 130 may correspond to a motor system typically employed in loudspeakers of this kind and thus may include the magnet 140 and the pole pieces 150 and 160. In the illustrated implementation, a decompression hole 190 may be symmetrically located about and along the central axis A to avoid the reflection or diffraction of sound waves emitted to the interior or posterior part of the loudspeaker 100. By way of example, the motor system 130 could be a vented ferrite motor system.

Figure 2:
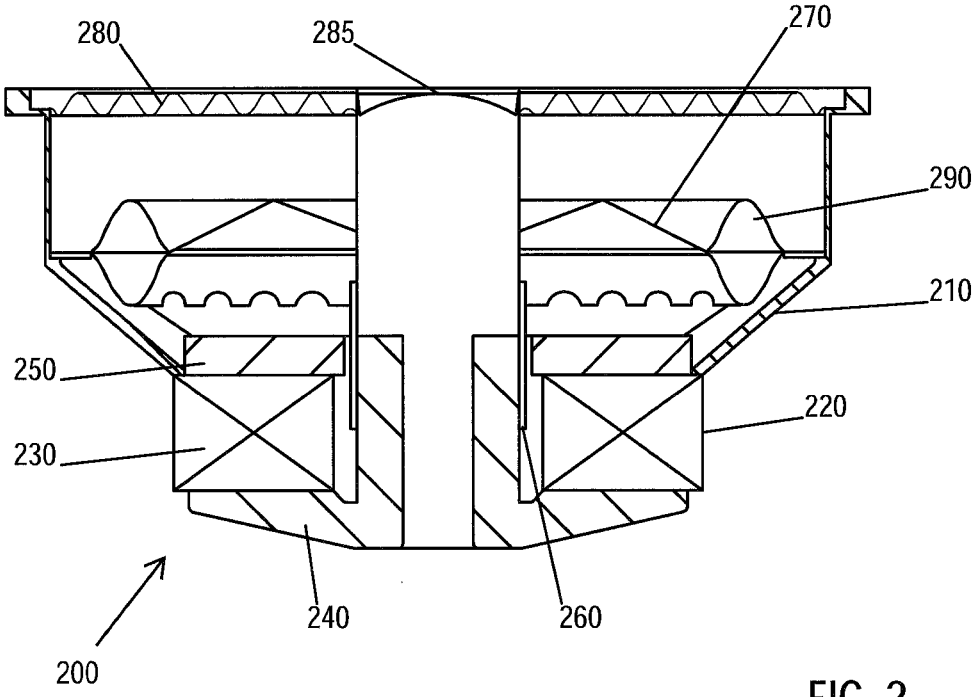
FIG. 2 is a cross-sectional elevation view illustrating an example of a loudspeaker according to another implementation of the invention.

FIG. 2 is a cross-sectional elevation view illustrating an example of a loudspeaker 200 according to another implementation of the invention. The loudspeaker 200 includes a frame 210, the width of which is minimized for applications inside a vehicle. The loudspeaker 200 further includes a motor system 220 comprising a magnet 230 and pole pieces 240 and 250, the pole pieces 240 and 250 being arranged in such a way that an air gap is provided between the pole pieces 240 and 250 in which a voice coil 260 is arranged. The voice coil 260 is connected to a diaphragm 270 and to a resilient centering device 280. As in the case of the implementation illustrated in FIG. 1, the motor system 230 shown in FIG. 2 may correspond to a motor system of the type employed in prior art loudspeakers, the function of which is well-known to those skilled in the art. The loudspeaker 200 further includes a dust cap 285 a central part of the centering device 280. Also similar to the implementation illustrated in FIG. 1, the loudspeaker 200 shown in FIG. 2 includes a flexible surround portion 290. Generally, the many of the components illustrated in FIG. 2 may be similar to corresponding components shown in FIG. 1, so that a detailed description of these components is not necessary.

When comparing the diaphragm 270 of FIG. 2 to the diaphragm 120 of FIG. 1, it can be seen that the overall width of the diaphragm 270 is smaller. Again, it can be seen that the surface of the resilient centering device 280 is larger than the surface of the diaphragm 270. With the implementation illustrated in FIG. 2, a loudspeaker 200 may be obtained that has a large excursion while maintaining the distortions low and while the overall size of the loudspeaker 200 is minimized Additionally, it is possible to obtain a distortion rate and a diaphragm excursion with a much smaller loudspeaker than has been possible in the prior art. It is possible to compensate the smaller emitting surface by larger excursions of the diaphragm 270 while keeping the distortion at an acceptable rate.

For the purpose of further comparison, it will again be noted that the loudspeaker 100 of FIG. 1 is configured in such a way that a maximum excursion of the diaphragm 120 may be obtained. In FIG. 2, the loudspeaker 200 is designed in such a way to minimize the space needed by the loudspeaker 200 but at the same time maintaining a large excursion of the diaphragm. By way of example, with an outer diameter of the loudspeaker 200 of FIG. 2 of 110 mm a maximum mechanical excursion of the diaphragm is around ±11 mm. As already mentioned in connection with FIG. 1, the excursion may not only depend on the outer diameter of the loudspeaker, but also on its optimized thickness of around 48 mm.

In some implementations, the loudspeaker 100 or 200 may be adapted for operating in the frequency range of a woofer. Accordingly, in one example the loudspeaker 100 or 200 operates in a frequency range between 20 Hz and 500 Hz, in another example between 20 Hz and 200 Hz, and in yet another example between 20 Hz and 100 Hz. It will be understood, however, that the loudspeaker 100 or 200 may operate in other low-frequency ranges, as well as in higher frequency ranges such as those ranges corresponding to medium (midrange) loudspeakers and tweeters.

In some implementations of the loudspeaker 100 or 200, the frame is constructed as a polymer or steel shell frame. Such materials in these implementations may help to optimize the thickness of the loudspeaker 100 or 200 and help to reduce the manufacturing costs of the loudspeaker 100 or 200.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A loudspeaker comprising:

a frame disposed around a central axis;

a magnet system mounted to the frame;

a resilient centering device;

a diaphragm movable relative to the central axis, the diaphragm mounted to the frame and mechanically communicating with the resilient centering device, and the diaphragm axially interposed between the magnet system and the resilient centering device; and a voice coil assembly, where the diaphragm mechanically communicates with the resilient centering device through the voice coil assembly, where the voice coil assembly includes a coil former interconnecting the diaphragm and the resilient centering device.

2. The loudspeaker of claim 1, where the resilient centering device includes an anterior side facing an outside of the loudspeaker and a posterior side facing the diaphragm and the magnet system.

3. The loudspeaker of claim 1, where the diameter of the resilient centering device is larger than the diameter of the diaphragm.

4. A loudspeaker comprising:

a diaphragm movable relative to a central axis;

a resilient centering device mechanically communicating with the diaphragm; a magnet system;

a suspension contacting the diaphragm and axially interposed between the magnet system and the resilient centering device; and a voice coil assembly, where the resilient centering device mechanically communicates with the diaphragm through the voice coil assembly, where the voice coil assembly includes a coil former interconnecting the diaphragm and the resilient centering device.

5. The loudspeaker of claim 4, where the diameter of the resilient centering device is larger than the diameter of the diaphragm.

* * * * *